United States Patent [19]

Strobach

[11] 4,093,529

[45] June 6, 1978

[54] RESISTOR ANODE FOR METAL TANK

[75] Inventor: Carl G. Strobach, Clarendon Hills, Ill.

[73] Assignee: Rheem Manufacturing Company, New York, N.Y.

[21] Appl. No.: 772,517

[22] Filed: Feb. 28, 1977

Related U.S. Application Data

[63] Continuation-in-part of Ser. No. 704,343, Jul. 12, 1976, abandoned, which is a continuation of Ser. No. 542,459, Jan. 20, 1975, abandoned.

[51] Int. Cl.[2] ..... C23F 13/00

[52] U.S. Cl. ..... 204/197; 204/286; 267/158; 267/161

[58] Field of Search ..... 204/147, 196, 148, 197; 267/158, 161

[56] References Cited

U.S. PATENT DOCUMENTS

| | | | |
|---|---|---|---|
| 2,486,871 | 11/1949 | Osterheld | 204/197 |
| 2,568,594 | 9/1951 | Robinson | 204/197 |
| 2,779,729 | 1/1957 | Jorgensen | 204/197 |
| 2,999,800 | 9/1961 | Rezside | 204/196 |
| 3,891,530 | 6/1975 | Alewitz | 204/197 |

*Primary Examiner*—T. Tung

*Attorney, Agent, or Firm*—Allegretti, Newitt, Witcoff & McAndrews

[57] ABSTRACT

The present invention is generally related to a new construction for a resistor-type anode. Sacrificial anodes are used in a variety of applications to protect metallic structures from corrosion. In order to control the rate of consumption of the sacrificial anode, a resistor is placed in series between the anode and the tank (cathode). This invention relates to an improved resistor anode construction for use in a tank, for example a hot water tank. The anode includes a core wire with a spring welded to the exposed end. The spring is biased against a disc shaped resistor. The assembly is retained by a metal cap swaged over an insulating sleeve fitted on the end of the anode.

4 Claims, 5 Drawing Figures

Fig. 1
PRIOR ART
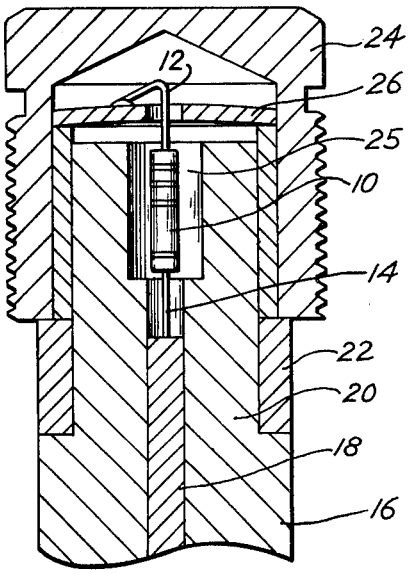
Fig. 3
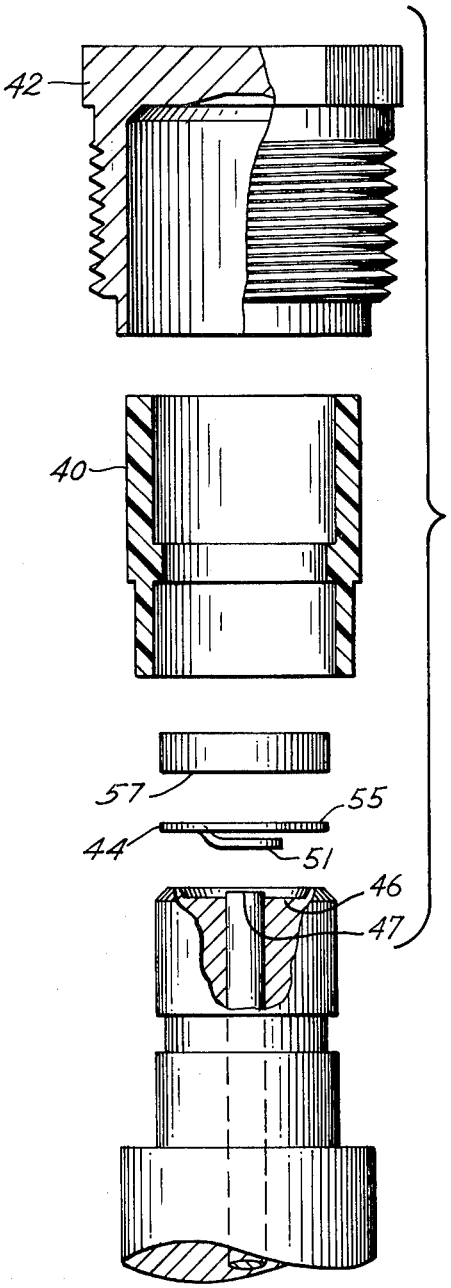
Fig. 2
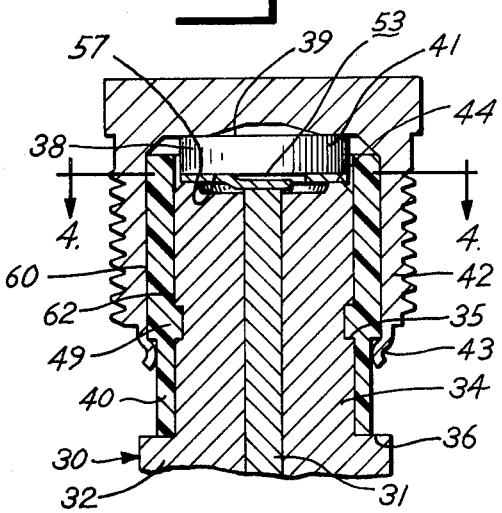
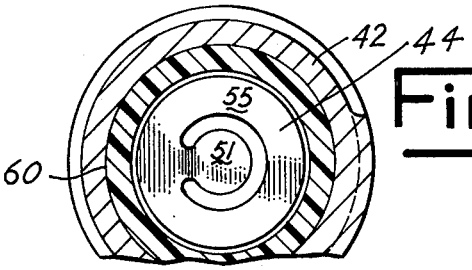
Fig. 4
Fig. 5
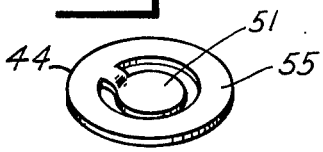

RESISTOR ANODE FOR METAL TANK

CROSS REFERENCE TO RELATED APPLICATION

This application is a continuation-in-part of application Ser. No. 704,343 filed July 12, 1976, now abandoned, a continuation of application Ser. No. 542,459 filed Jan. 20, 1975, now abandoned.

BACKGROUND OF THE INVENTION

Conventional hot water tanks are subject to corrosion during use. To prevent this corrosion, sacrifical anodes, normally constructed of magnesium, aluminum or zinc, are inserted into the tank. The sacrificial anode is slowly consumed during the protection process and results in the production of an electrical current. As the anode is slowly depleted, the simultaneously generated electrical current cathodically protects the tank.

The service life of the anode is primarily dependent upon the amount of the electrical current flow generated by the anode in cathodically protecting the tank. In many fresh water supplies, particularly those having a high mineral content, the current flow is relatively high, resulting in a corresponding decrease of the useful life of the anode.

A resistor type anode has been constructed in the prior art in order to limit the amount of current flow and, thereby extend the useful life of the anode. Referring to FIG. 1, a conventional prior art resistor anode construction is shown which utilizes a standard barrel bodied, pigtailed type carbon resistor 10 having pigtails or copper wire connections 12 and 14 which must be electrically connected to the unit by soldering. The anode 16 is cylindrically shaped, has a central core wire 18 along the longitudinal axis and includes a machined neck portion 20 of lesser diameter than the main portion of the anode 16. An insulator sleeve 22, having a cylindrically shaped inner surface with a diameter substantially equal to the outer diameter of the neck portion 20, is inserted over the neck portion 20 of the anode 16.

A steel anode cap 24 is provided to fit snugly over and around the outside portion of the plastic insulating sleeve 22. The resistor 10 is positioned in a bore 25 which is defined in the neck portion 20. The bore 25 has a volume greater than that of resistor 10 in order to comfortably receive the resistor 10. The pigtail 12 of resistor 10 is then connected either to the inner portion of the steel cap 24 or to a brass disc 26 which may be force-fitted into the cap 24 and electrically connected therewith. The other pigtail 14 of the resistor 10 is electrically connected by soldering to the inner core wire 18.

While generally effective for the purpose intended, the prior construction utilizing the barrel type resistor 10 with pigtails 12 and 14, had several drawbacks. For example, it was somewhat difficult and time consuming to electrically solder both ends of the pigtail to the disc 26 and core wire 18, respectively. Also, this type of construction sacrificed ruggedness, since the resistor 10 (which is free to move within the anode 16) and its connections 12 and 14 could become easily damaged or disconnected during assembly and shipment, or as a result of moisture accumulated in the location surrounding the resistor during use.

SUMMARY OF THE INVENTION

The present invention is adapted for use in conjunction with an anode assembly of the type having a sacrificial anode body, a conductive core wire longitudinally displaced within the anode, and a conductive metal cap fitting over one end of the anode and electrically insulated therefrom. The improvement is primarily related to a resistor electrically connected between the cap and the core wire, with the improvement comprising a disc-shaped carbon resistor disposed between the one end of the anode and the inner surface of the metal cap adjacent to the one end of the anode. The disc-shaped resistor is in electrical contact with the core wire, so that the disc-shaped resistor is in series between the cap and the anode. In the preferred form, the invention also includes a specially constructed conductive metal spring electrically and mechanically connected at one end to the core wire and biased against the disc-shaped resistor at the other end.

Accordingly, it is an object of the present invention to provide an improved resistor for a resistor anode assembly of the type having a sacrificial anode.

Another object of the present invention is to provide such an improved resistor which will minimize the likelihood of damage during assembly, shipment and use and which will maximize ruggedness of the resistor in connection with the anode assembly.

Still a further object of the present invention is to provide an improved resistor for an anode assembly having a sacrificial anode, which resistor will maintain electrical connection with the appropriate components of the resistor anode assembly at all times during use, and which will require a minimum of time and effort to assemble.

Another object of the present invention is to provide an improved simplified resistor-anode assembly which will be lower in both material and assembly cost than the devices known heretofore.

These and other objects, advantages and features of the present invention will be more fully understood by reference to the detailed description and the preferred embodiment.

BRIEF DESCRIPTION OF THE DRAWINGS

There follows a brief description and the drawings, showing a presently preferred embodiment of the present invention, and a prior art construction wherein like numerals refer to like elements, and wherein:

FIG. 1 is a cross-sectional view of the prior art resistor anode assembly;

FIG. 2 is a cross-section view of the resistor anode assembly of the present invention;

FIG. 3 is an exploded view of the components of the improved resistor anode assembly of the present invention as shown in FIG. 2;

FIG. 4 is a sectional view of the improved anode assembly taken along the line 4—4 in FIG. 2; and FIG. 5 is a perspective view of the spring for the anode assembly of FIG. 2.

DETAILED DESCRIPTION OF THE PREFERRED EMBODIMENT

Referring now to FIGS. 2 through 5, there is shown an improved resistor anode assembly which is adapted to lower the cost of assembly and the materials of a resistor anode device, and to improve the ruggedness and reliability of the design. The assembly includes a cylindrically shaped sacrificial anode 30 which is generally made of magnesium, aluminum or zinc and, in the preferred embodiment shown in the drawing, is approximately in the range of 12 to 53 inches long and 0.70 to 0.85 inches in diameter. The improvement of the invention enables use of generally smaller anodes in comparison with prior art requirements.

Anode 30 is cylindrically shaped and includes a steel core wire 31 disposed longitudinally within anode 30. Anode 30 is defined by a main section 32, and an upper neck section 34 of less diameter than the main section 32. An annular shoulder 36 is formed at the junction between the main section 32 and the neck section 34 of the anode 30. Because of the nature of this invention, the anode 30 need not include a bore such as the bore 25 of the prior art anode 16. A circumferential groove 35 is, however, provided on the upper neck section 34.

The improved assembly also includes a disc-shaped resistor 38, an insulator sleeve 40, a metal anode cap 42 and a steel spring 44. One end of the spring 44 is positioned in opposed relation to end surface 46 of the neck section 34 and is connected to the exposed end 47 of core wire 31. The opposite end of spring 44 engages resistor 38.

For assembly, the insulator sleeve 40 may include an inwardly projecting circumferential flange 49 to cooperate with groove 35. Alternatively, the material of the sleeve 40 does not include such a flange 49. Rather, the material of sleeve 40 flows into the groove 35 during assembly.

Sleeve 40 is somewhat flexible so that it may be slipped over the neck section 34 of the anode 30 with the flange 49 positioned in groove 35. The disc-shaped resistor 38 is placed on top of the spring 44 and is contained within the sleeve 40, except for the top surface 39 of resistor 38 which engages the inside surface 41 of cap 42. The assembly is then force fitted into the anode cap 42 and the lower edge 43 of cap 42 is swaged against the sleeve 40.

Alternatively, before swaging edge 43, the sleeve 40 and disc 38 may be positioned in the cap 42. Then, the subassembly sleeve 40 may be force fitted upon the neck portion 34 of the anode 30 so that disc resistor 38 impinges against the spring 44.

In the preferred embodiment, the spring 44 is made of stainless steel and is stamped from a flat plate to define an inner anode end 51 projecting into a passage 53 defined along the axis of spring 44. The remaining portion of spring 44 is then a circumferential portion 55 which is generally flat and engages the lower surface 57 of disc resistor 38. Thus, spring 44 is interposed between the end surface 46 of the anode 30 and lower surface 57 of the disc-shaped resistor 38. Importantly, the anode end 51 of spring 44 is welded to the exposed end 47 of core wire 31 and is located between the anode 30 and disc shaped resistor 38 to maintain improved contact between the anode 30, disc 38, and steel cap 42. The end 47 of wire 31 is exposed to facilitate welding of anode end 51 to wire 31. Welding is effected by placement of a welding probe into passage 53 against end 51 of spring 44. The special construction of spring 44 permits easy use of a welding probe and thus greatly facilitates such welding and improves significantly the ease of assembly of the total anode.

After the assembly has been force fitted, the upper surface area 39 of the disc-shaped resistor 38 fits snugly against the lower internal surface 41 of the cap 42. The spring 44 maintains a pressure contact against the lower surface 57 of the resistor 38 and biases the resistor 38 against the cap 42 to improve the contact therewith. The disc-shaped resistor 38 is in series connection between the cap 42 and anode 30. Note that the series contact requires electrical connection at surfaces 39 and 57. Because sleeve 40 encircles resistor 38, short circuiting is prevented.

The disc-shaped resistor 38 is shaped to conform with the inner dimensions of the insulating sleeve 40 and is constructed of carbon particles which are pressed together into the shape of a disc, utilizing a suitable binder. The disc is then impregnated with epoxy or a phenolic, and the upper and lower flat circular surfaces of the disc are sprayed with brass in order to improve the electrical contact of these surfaces.

The insulating sleeve 40 is formed of a micarta type insulator or, in the preferred embodiment, a polymeric insulating material such as the trademarked product of General Electric Company, Noryl 731. As can be seen from the cross-sectional view of FIG. 3, sleeve 40 has a substantially cylindrical inner surface and outer surface. The outer surface may be frusto conically shaped. A frusto conical outer surface of the sleeve 40 is designed to improve the force fit of the assembly which fits snugly against the outer surface of the neck portion 34 of anode 30 and against the inner cylindrically shaped surface of the cap 42. The sleeve 40 is also slightly elastic to facilitate assembly and to accommodate changes due to expansion or contraction of the anode with changes in temperature. The material, Noryl 731, made by General Electric Company is generally compressed about 1.2% to effect a good seal against water. Preferable materials for sleeve 40 have a Rockwell hardness of about R119. The sleeve material and structure is critical in order to prevent moisture formation in the cap 42 and subsequent corrosion and ineffectiveness of the anode 30.

To further enhance the moisture seal between the anode 30 and cap 42, an epoxy material 60 may be placed in the region on both sides of the sleeve 40. A typical preferred epoxy is No. 2214 epoxy made by 3M Company or No. A-1340-B epoxy made by B. F. Goodrich Company.

While in the foregoing there has been described a presently preferred embodiment of the present invention, it should be understood that the embodiment is merely illustrative of the principles of this invention and that other embodiments may be made without departing from the true spirit and scope thereof.

What is claimed is:

1. An improved resistor anode assembly comprising, in combination:

an anode with a longitudinal axis and of generally cylindrical shape having a generally flat top surface, an exposed, center core wire generally on the axis, and including a groove adjacent the top surface;

a conductive metal cap including a top and cylindrical side wall to define a cylindrical receptacle for receipt of the anode, a lower internal surface in the receptacle, an external surface of said side wall being formed for attaching the cap through an opening in the tank;

a disc-shaped resistor having opposed generally flat contact surfaces, said resistor being interposed between the internal surface of the cap and the exposed end of the core wire, one of said disc contact surfaces being in mechanical and electrical contact with the internal surface of the cap;

a conductive biasing spring having an anode end and a resistor end, the spring having an axial passage with the anode end positioned at one end of the passage along the axis thereof whereby the anode end is accessible to a welding probe projecting in the passage, said anode end being in mechanical and electrical contact by welding to the core wire and the resistor end being generally flat to provide mechanical and electrical friction contact with the other contract surface of said disc; and an elastic deformable, hollow, insulating sleeve positioned in said receptacle between the cap side wall and said anode, said sleeve being generally cylindrical and including means cooperating with the anode groove on the inside to facilitate holding the anode, the diameter of the anode being less than the cap receptacle, said anode also projecting into said receptacle, said cap being force fitted and swaged onto said sleeve to retain the anode, said sleeve also separating the resistor, and conductive biasing spring from the cylindrical side wall of the cap, whereby said resistor and spring provide a sole conductive, series path for electrical flow between the anode core wire and the lower internal surface of the cap and maintain said sole path by prevention of electrical contact between the conductive biasing spring or the edge of said disc and said cap regardless of dimensional changes in said anode assembly and by accommodation of any dimensional changes due to expansion or compression of the assembly.

2. The anode assembly of claim 1 including epoxy sealing material on both sides of said sleeve to seal the anode to the sleeve and the cap to the sleeve.

3. The anode assembly of claim 1 wherein said spring is formed from a plate with an internal portion of the plate stamped and separated from the circumferential portion of the plate except for a bridging portion, whereby the internal portion defines the anode end and the circumferential portion defines the resistor end of the spring.

4. The anode assembly of claim 1 wherein the flat contact surfaces of the disc shaped resistor are covered with conductive material.

* * * * *